US006352465B1

(12) United States Patent
Heymann et al.

(10) Patent No.: US 6,352,465 B1
(45) Date of Patent: Mar. 5, 2002

(54) TOY KNIFE

(76) Inventors: Kirk D. Heymann; Carrie M. Heymann, both of 5192 Hwy. North, Robertsville, MO (US) 63072

( * ) Notice: Subject to any disclaimer, the term of this patent is extended or adjusted under 35 U.S.C. 154(b) by 0 days.

(21) Appl. No.: 09/648,237

(22) Filed: Aug. 25, 2000

(51) Int. Cl.[7] ..... A63H 33/30
(52) U.S. Cl. ..... 446/473; 30/123.3
(58) Field of Search ..... 30/123.3; 222/78; 446/473

(56) References Cited

U.S. PATENT DOCUMENTS 714,534 A 11/1902 Thomas
2,656,600 A * 10/1953 Barbee
2,826,859 A 3/1958 Shaffer
3,712,748 A 1/1973 Wilmans
3,811,783 A 5/1974 Johnson
D257,635 S 12/1980 Carreiro
5,181,875 A * 1/1993 Hasegawa ..... 446/473 X
5,288,274 A 2/1994 Bell et al.

* cited by examiner

*Primary Examiner*—John A. Ricci

(57) ABSTRACT

A toy knife for exercise and entertainment purposes. The toy knife includes a handle portion. The handle portion has a first end, a second end and a peripheral wall extending therebetween. The handle portion has a lumen therein. The first end of the handle portion has an opening therein extending into the lumen. The handle portion comprises a resiliently elastic material. A covering member covers the opening in the first end of the handle portion. A blade portion is elongate and has a distal end, a proximal end, a first edge and a second edge. The distal end is integrally coupled to the second end of the handle portion. The blade portion has a bore extending into the distal end. At least one opening extends from the first edge to the bore. The bore is fluidly coupled to the lumen.

8 Claims, 3 Drawing Sheets

TOY KNIFE

BACKGROUND OF THE INVENTION

1. Field of the Invention

The present invention relates to toy knives and more particularly pertains to a new toy knife for exercise and entertainment purposes.

2. Description of the Prior Art

The use of toy knives is known in the prior art. More specifically, toy knives heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,288,274; U.S. Pat. No. 2,826,859; U.S. Pat. No. 3,811,783; U.S. Pat. No. 3,712,748; U.S. Des. Pat. No. 257,635; and U.S. Pat. No. 714,534.

While these devices fulfill their respective, particular objectives and requirements, the aforementioned patents do not disclose a new toy knife. The inventive device includes a handle portion. The handle portion has a first end, a second end and a peripheral wall extending therebetween. The handle portion has a lumen therein. The first end of the handle portion has an opening therein extending into the lumen. The handle portion comprises a resiliently elastic material. A covering member covers the opening in the first end of the handle portion. A blade portion is elongate and has a distal end, a proximal end, a first edge and a second edge. The distal end is integrally coupled to the second end of the handle portion. The blade portion has a bore extending into the distal end. At least one opening extends from the first edge to the bore. The bore is fluidly coupled to the lumen.

In these respects, the toy knife according to the present invention substantially departs from the conventional concepts and designs of the prior art, and in so doing provides an apparatus primarily developed for the purpose of exercise and entertainment purposes.

SUMMARY OF THE INVENTION

In view of the foregoing disadvantages inherent in the known types of toy knives now present in the prior art, the present invention provides a new toy knife construction wherein the same can be utilized for exercise and entertainment purposes.

The general purpose of the present invention, which will be described subsequently in greater detail, is to provide a new toy knife apparatus and method which has many of the advantages of the toy knives mentioned heretofore and many novel features that result in a new toy knife which is not anticipated, rendered obvious, suggested, or even implied by any of the prior art toy knives, either alone or in any combination thereof.

To attain this, the present invention generally comprises a handle portion. The handle portion has a first end, a second end and a peripheral wall extending therebetween. The handle portion has a lumen therein. The first end of the handle portion has an opening therein extending into the lumen. The handle portion comprises a resiliently elastic material. A covering member covers the opening in the first end of the handle portion. A blade portion is elongate and has a distal end, a proximal end, a first edge and a second edge. The distal end is integrally coupled to the second end of the handle portion. The blade portion has a bore extending into the distal end. At least one opening extends from the first edge to the bore. The bore is fluidly coupled to the lumen.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toy knife apparatus and method which has many of the advantages of the toy knives mentioned heretofore and many novel features that result in a new toy knife which is not anticipated, rendered obvious, suggested, or even implied by any of the prior art toy knives, either alone or in any combination thereof.

It is another object of the present invention to provide a new toy knife which may be easily and efficiently manufactured and marketed.

It is a further object of the present invention to provide a new toy knife which is of a durable and reliable construction.

An even further object of the present invention is to provide a new toy knife which is susceptible of a low cost of manufacture with regard to both materials and labor, and which accordingly is then susceptible of low prices of sale to the consuming public, thereby making such toy knife economically available to the buying public.

Still yet another object of the present invention is to provide a new toy knife which provides in the apparatuses and methods of the prior art some of the advantages thereof, while simultaneously overcoming some of the disadvantages normally associated therewith.

Still another object of the present invention is to provide a new toy knife for exercise and entertainment purposes.

Yet another object of the present invention is to provide a new toy knife which includes a handle portion. The handle portion has a first end, a second end and a peripheral wall extending therebetween. The handle portion has a lumen therein. The first end of the handle portion has an opening therein extending into the lumen. The handle portion comprises a resiliently elastic material. A covering member covers the opening in the first end of the handle portion. A blade portion is elongate and has a distal end, a proximal end, a first edge and a second edge. The distal end is integrally coupled to the second end of the handle portion. The blade portion has a bore extending into the distal end. At least one opening extends from the first edge to the bore. The bore is fluidly coupled to the lumen.

Still yet another object of the present invention is to provide a new toy knife that may be used for sparring purposes.

Even still another object of the present invention is to provide a new toy knife that has a felt edge for soaking up of fluid such that the fluid is easily transferred by running the edge on another person.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
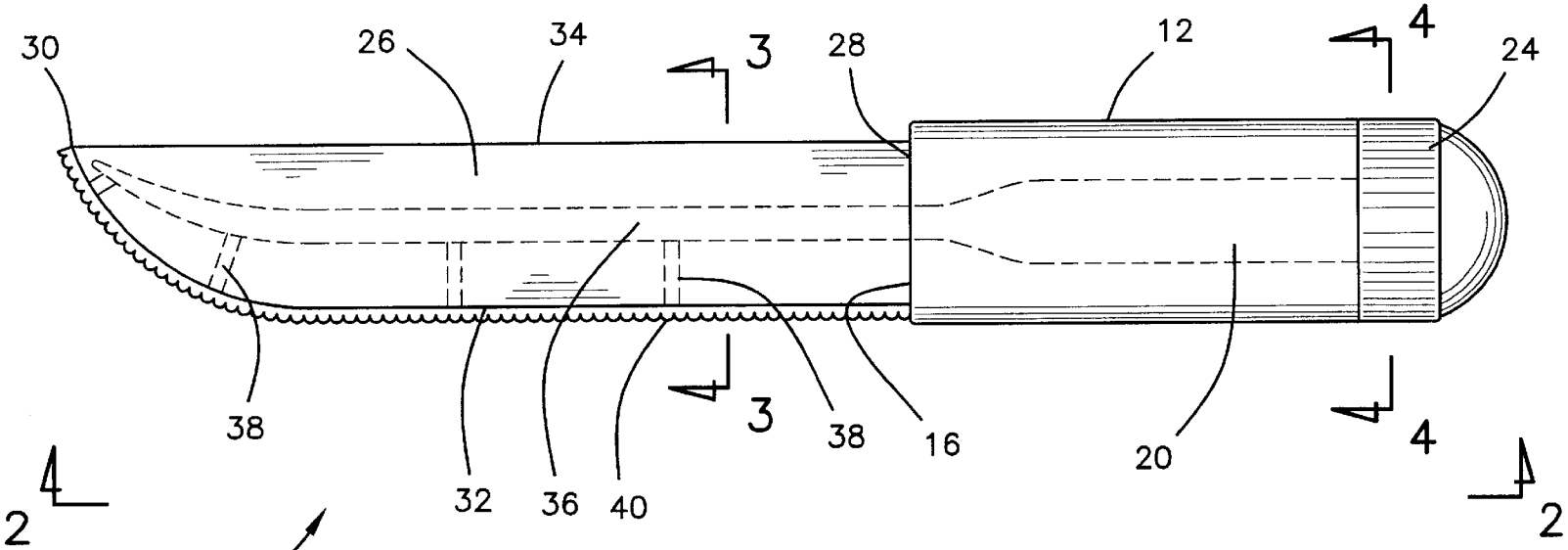
FIG. 1 is a schematic side view of a new toy knife according to the present invention.
Figure 2:
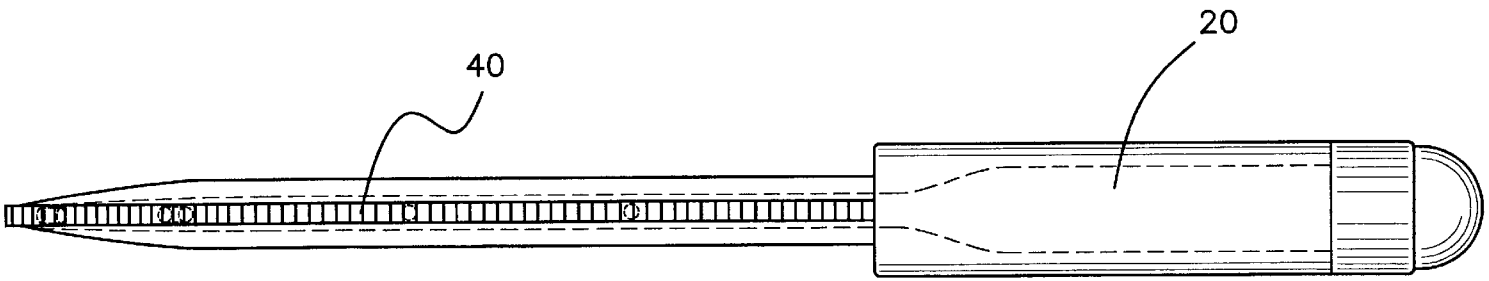
FIG. 2 is a schematic bottom view of the present invention.
Figure 5:
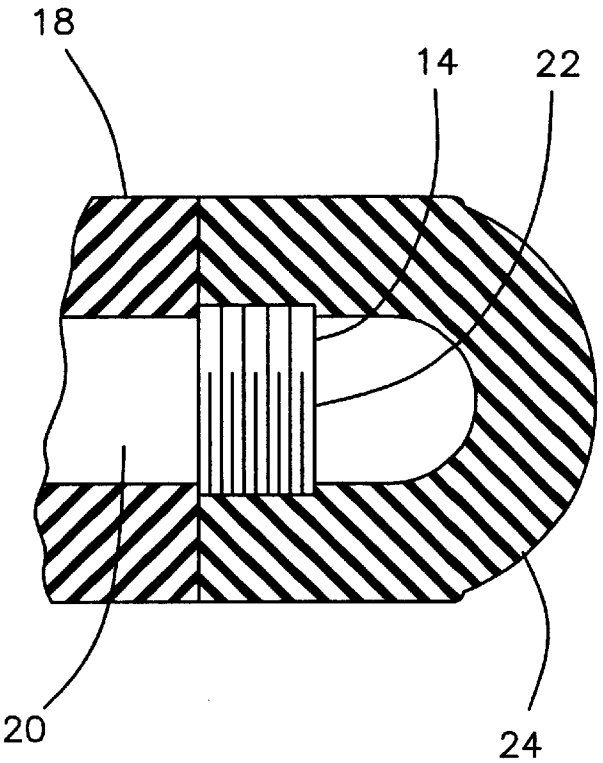
FIG. 5 is a schematic cross-sectional view taken along line 5—5 of the present invention.
Figure 4:
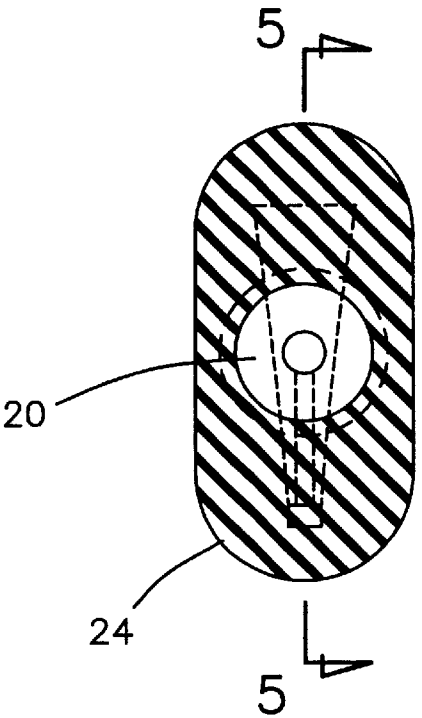
FIG. 4 is a schematic cross-sectional view taken along line 4—4 of the present invention.
Figure 3:
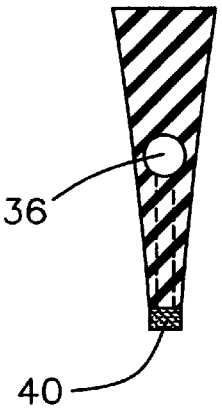
FIG. 3 is a schematic front cross-sectional view taken along line 3—3 of the present invention.
Figure 6:
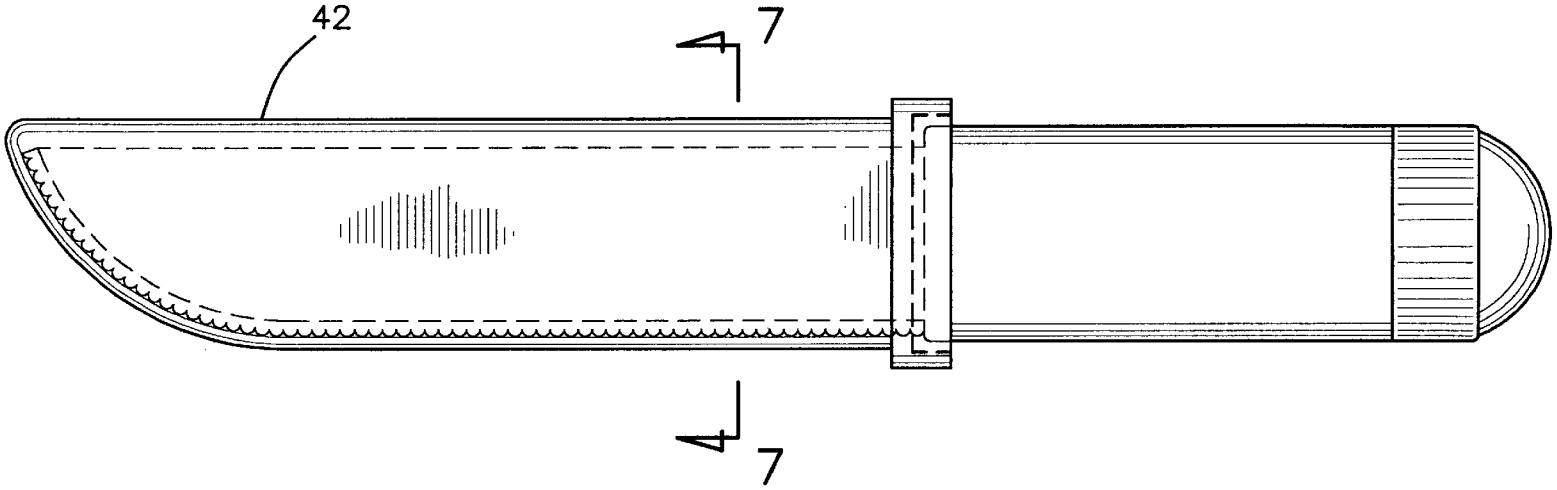
FIG. 6 is a schematic side view of the present invention.
Figure 7:
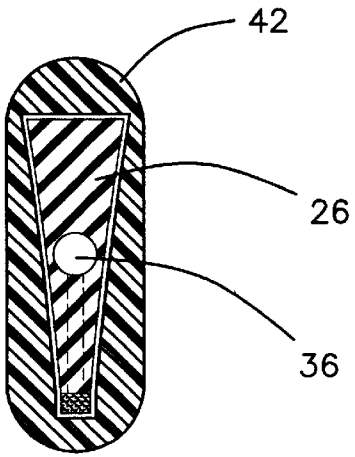
FIG. 7 is a schematic cross-sectional view taken along line 7—7 of the present invention.

With reference now to the drawings, and in particular to FIGS. 1 through 7 thereof, a new toy knife embodying the principles and concepts of the present invention and generally designated by the reference numeral 10 will be described.

As best illustrated in FIGS. 1 through 7, the toy knife 10 generally comprises a handle portion 12. The handle portion 12 has a first end 14, a second end 16 and a peripheral wall 18 extending therebetween. The handle portion 12 has a lumen 20 therein. The first end 14 of the handle portion 12 has an opening 22 therein. The peripheral wall 18 has threads thereon positioned generally adjacent to the first end 14. The handle portion 12 comprises a resiliently elastic material. The resiliently elastic material preferably comprises an elastomeric material.

A covering member 24 covers the opening 22 in the first end 14 of the handle portion 12. The covering member 24 comprises a cap, which is generally hollow and comprises an elastomeric material. The cap has a threaded inner wall adapted for coupling to the threads on the handle portion 12 such that an inner portion of the cap is in communication with the lumen 20. The covering member 24 comprising an elastomeric material.

A blade portion 26 is elongate and has a distal end 28, a proximal end 30, a first edge 32 and a second edge 34. The distal end 28 is integrally coupled to the second end 16 of the handle portion 12. The blade portion 26 has a bore 36 extending into the distal end 28 to a point generally adjacent to the proximal end 30. A plurality of openings 38 extends from the first edge 32 to the bore 36. The bore 36 is fluidly coupled to the lumen 20. The blade portion 26 comprises an elastomeric material. The first edge 32 has a serrated material 40 coupled thereto. The serrated material 40 preferably comprises a cloth material which is ideally a substantially rigid felt material.

A sheathing means 42 for sheathing the blade portion 26 comprises a sheath adapted for removably receiving the blade portion 26.

In use, fluid is placed in the lumen of the handle portion. The user squeezes the handle portion which forces the fluid through the bore and out the channels. The user may also press on the cap portion which will force air into the lumen to urge the fluid into the bore and out the channels.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A toy knife device, said device comprising:

a handle portion, said handle portion having a first end, a second end and a peripheral wall extending therebetween, said handle portion having a lumen therein, said first end of said handle portion having an opening therein extending into said lumen, said handle portion comprising a resiliently elastic material;

a covering member for covering said opening in said first end of said handle portion;

a blade portion, said blade portion being elongate and having a distal end, a proximal end, a first edge and a second edge, said distal end being integrally coupled to said second end of said handle portion, said blade portion having a bore extending into said distal end, at least one opening extending from said first edge to said bore, said bore being fluidly coupled to said lumen;

wherein said blade portion further comprises a plurality of openings extending from said first edge to said bore; and wherein said first edge of said blade member has a serrated material coupled thereto, said serrated material comprising a cloth material.

2. The toy knife device as in claim 1, wherein said device comprises:

said peripheral wall having threads thereon positioned generally adjacent to said first end;

said covering member comprising a cap, being generally hollow and comprising an elastomeric material, said cap having a threaded inner wall adapted for coupling to said threads on said handle portion such that an interior of said cap is in communication with said lumen, said covering member comprising an elastomeric material.

3. The toy knife device as in claim 1, further comprising:

a sheathing means for sheathing said blade portion, said sheathing means comprising a sheath adapted for removably receiving said blade portion.

4. A toy knife device, said device comprising:

a handle portion, said handle portion having a first end, a second end and a peripheral wall extending therebetween, said handle portion having a lumen therein, said first end of said handle portion having an opening therein extending into said lumen, said peripheral wall having threads thereon positioned generally adjacent to said first end, said handle portion comprising a resiliently elastic material, said resiliently elastic material comprising an elastomeric material;

a covering member for covering said opening in said first end of said handle portion, said covering member comprising a cap, said covering member being generally hollow, said cap having a threaded inner wall adapted for coupling to said threads on said handle portion such that an inner portion of said cap is in communication with said lumen, said covering member comprising an elastomeric material;

a blade portion, said blade portion being elongate and having a distal end, a proximal end, a first edge and a second edge, said distal end being integrally coupled to said second end of said handle portion, said blade portion having a bore extending into said distal end to a point generally adjacent to said proximal end, a plurality of openings extending from said first edge to said bore, said bore being fluidly coupled to said lumen, said blade portion comprising an elastomeric material, said first edge having a serrated material coupled thereto, said serrated material comprising a cloth material; and a sheathing means for sheathing said blade portion, said sheathing means comprising a sheath adapted for removably receiving said blade portion.

5. A toy knife device, said device comprising:

a handle portion having a first end, a second end and a peripheral wall extending therebetween, the first end of said peripheral wall having threads formed thereon said handle portion having a lumen therein, said first end of said handle portion having an opening therein extending into said lumen, said handle portion comprising a resiliently elastic material;

a covering member for covering said opening in said first end of said handle portion, said covering member comprising a cap, being generally hollow, said cap having a threaded inner wall adapted for coupling to said threads on said handle portion such that an interior of said cap is in communication with said lumen, said covering member comprising an elastomeric material;

an elongate blade portion having a distal end, a proximal end, a first edge and a second edge, said distal end being integrally coupled to said second end of said handle portion, said blade portion having a bore extending into said distal end, at least one opening extending from said first edge to said bore, said bore being fluidly coupled to said lumen.

6. The toy knife device as in claim 5, wherein said blade portion further has a plurality of openings extending from said first edge to said bore.

7. The toy knife device as in claim 5, wherein the first edge of said blade portion has a serrated material coupled thereto, said serrated material comprising a cloth material.

8. The toy knife device as in claim 5, further comprising a sheathing means for sheathing said blade portion, said sheathing means comprising a sheath adapted for removably receiving said blade portion.

* * * * *